United States Patent [19]

Roth

[11] Patent Number: 4,870,984

[45] Date of Patent: Oct. 3, 1989

[54] PORTABLE SHELTER WITH WIND BREAK

[76] Inventor: Leo E. Roth, 70354 Sunrise Dr., Edwardsburg, Mich. 49112

[21] Appl. No.: 297,207

[22] Filed: Jan. 17, 1989

[51] Int. Cl.[4] ..... A47C 21/00

[52] U.S. Cl. ..... 135/109; 296/77.1; 52/63; 52/69

[58] Field of Search ..... 52/63, 64, 69, 143; 135/90, 109, 111, 113; 296/77.1

[56] References Cited

U.S. PATENT DOCUMENTS

| | | | |
|---|---|---|---|
| 2,465,147 | 3/1949 | Butter et al. | 135/109 X |
| 2,632,454 | 3/1953 | Skogen | 135/109 |
| 2,701,038 | 2/1955 | Mooney | 52/69 |
| 2,712,677 | 7/1955 | Hyde | 52/69 X |
| 3,826,270 | 7/1974 | Hentges | 135/109 X |
| 3,854,746 | 12/1974 | Flynn et al. | 135/109 X |
| 4,016,951 | 4/1977 | Dick et al. | 52/143 X |
| 4,063,318 | 12/1977 | Nicholson | 135/109 X |
| 4,285,529 | 8/1981 | Vaillancoult | 296/77.1 X |
| 4,742,653 | 5/1988 | Napier et al. | 52/69 X |

FOREIGN PATENT DOCUMENTS

| | | | |
|---|---|---|---|
| 1429281 | 11/1968 | Fed. Rep. of Germany | 135/109 |

*Primary Examiner*—David A. Scherbel
*Assistant Examiner*—Creighton Smith
*Attorney, Agent, or Firm*—James D. Hall; Thomas J. Dodd; Todd A. Dawson

[57] ABSTRACT

A portable shelter having a pair of spaced apart runners supporting a frame carrying a suitable covering. A hinged plate extends between the runners and is shiftable between a lower position extendintg to the bottom of the runners for blocking the flow of air between the runners under the covering and a raised position to allow non-interfering movement of the shelter across the ground or ice.

4 Claims, 2 Drawing Sheets

PORTABLE SHELTER WITH WIND BREAK

SUMMARY OF THE INVENTION

This invention relates to a portable shelter and will have specific application to a shelter which can be moved from location to location upon runners and which carries a frame having a covering.

In the shelter of this invention, the covering which is carried by the runner-supported frame has at least three enclosing sides in which one of the covering sides extends to and along each runner. The runners are of wall form and a hinged plate extends between the runners under the frame and covering. The plate serves as a wind break and is shiftable between a lower position which extends to the bottom of the runners and serves to block the flow of air under the cover and between the runners and a raised position which allows non-interfering movement of the shelter across the ground or other supporting surfaces. In its form, the shelter of this invention can be used for ice fishing, by electrical repairmen, for sewer and excavation work, and even to house a portable toilet.

Accordingly, it is an object of this invention to provide a portable shelter which can be moved in a simple and efficient manner over the ground and which is of simple operation.

Another object of this invention is to provide a portable shelter which is of collapsible form for purposes of ease of transportation and storage and which includes a wind break which serves to retard the flow of air into the interior of the shelter under the shelter's covering.

Still another object of this invention is to provide a portable shelter which is of economical construction and which serves to protect the inhabitants of the shelter from the adverse climatical elements.

Other objects of this invention will become apparent upon a reading of the following description.

BRIEF DESCRIPTION OF THE DRAWINGS

A preferred embodiment of this invention has been chosen for purpose of illustration and description wherein.

DESCRIPTION OF THE PREFERRED EMBODIMENT

Figure 1:
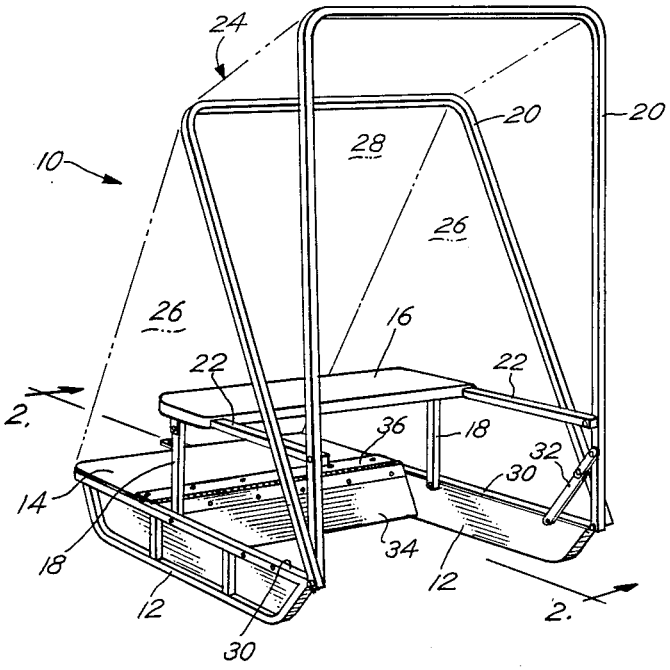
FIG. 1 is a perspective view of the shelter shown with its frame in the extended, usable position and with the covering thereof shown in broken lines for illustrative purposes.

The preferred embodiment illustrated is not intended to be exhaustive or to limit the invention to the precise form disclosed. It is chosen and described in order to best explain the principles of the invention and to enable others skilled in the art to best utilize the invention.

As shown in FIGS. 1–4, shelter 10 includes spaced apart parallel runners 12 which are connected together at the aft end of the runners by a floor 14 supported upon transverse rails 15 and a seat 16 located approximately mid-length of the runners. Pivotally connected vertical supports 18 extend between runners 12 and seat 16. A pair of inverted U-shaped frames 20 are pivotally connected to the front end of runners 12 and extend upwardly. The forward most frame 20 is pivotally connected to horizontal supports 22 which extend rearwardly and connect also to seat 16. A flexible cover 24, such as formed from canvas and illustrated by broken lines, extends about and over frames 20. Cover 24 includes left and right sides 26 which extend to at least upper edges 30 of the runners 12 and a rear side 28. The front of cover 22 may be open or include a door which allows access into the interior of shelter 10. The construction of cover 24 may have numerous variations well known in the art. Frames 20, rails 15, and supports 18 and 22 may be of a light metal, such as aluminum construction, while floor 14 and seat 16 may be either wooden or metal construction. Runners 12 are preferably of a frame form covered by a wall so as to produce a solid form of runner. By being of solid form, wind is prevented from entering the shelter from either the right or left sides.

Figure 2:
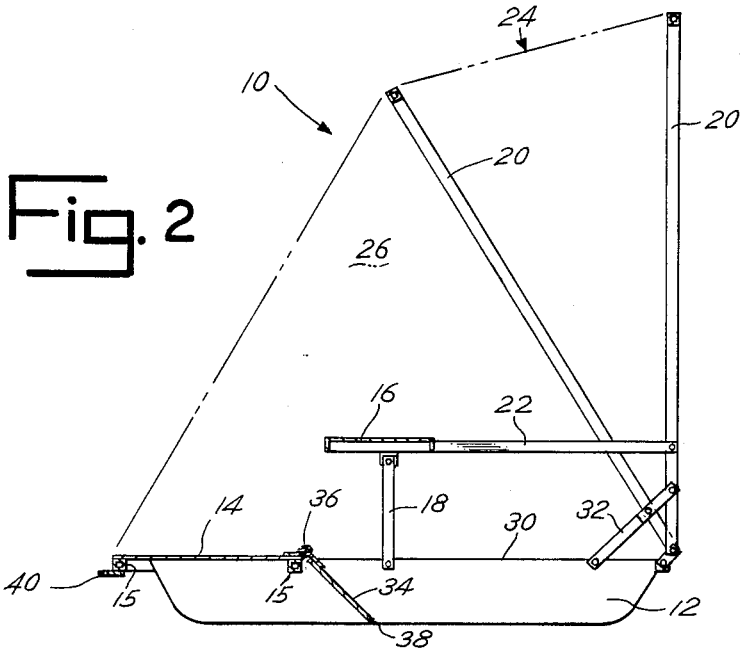
FIG. 2 is a sectional view taken along line 2—2 of FIG. 1.
Figure 3:
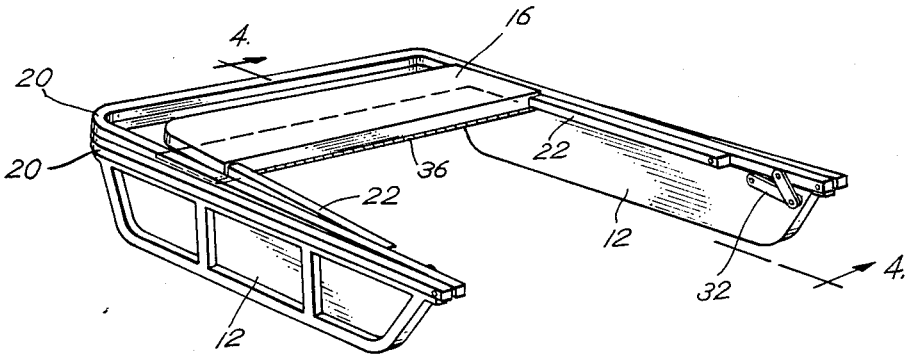
FIG. 3 is a perspective view of the shelter showing the frame thereof in its collapsed form.
Figure 4:
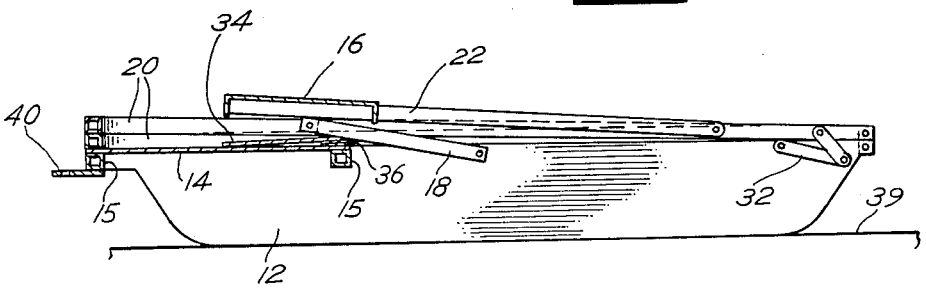
FIG. 4 is a sectional view taken along line 4—4 of FIG. 4.

By pivotally connecting frames 20 and supports 18 and 22, the support frames and seat can be collapsed or folded as illustrated in FIGS. 3 and 4 for ease of transportation and storage. The cover 24 of the shelter may be removed and folded prior to folding of the shelter. After the shelter is pulled to the desired site over the ground or ice, the frames and seat can be swung from their collapsed or lowered position shown in FIGS. 3 and 4 into their raised position shown in FIGS. 1 and 2 and the cover unfolded and placed over vertically extending frames 20 for usage of the shelter. In normal climatic conditions and intended use, the rear of the shelter would be placed into the wind with the front and usually open end of the shelter being position down wind. A locking brace 32 extends between one runner 12 and a frame 20 and is used when placed in its extended and locked position to secure frames 20 in their raised, cover-supporting positions. As thus far described, shelter 10 is of a known form and construction.

While cover 24 is designed to extend at least to the level of the upper edges of runners 12, there is a tendency for the wind as it is driven against the rear of the shelter to pass under floor 14 and into the shelter interior. This flow of air is blocked by a wind break which includes a plate 34. Plate 34 extends fully between runners 12 and is connected by hinge 36 at its upper edge to the forward edge of floor 14. The width of plate 34 as measured from hinge 36 to the lower edge 38 of the plate preferably exceeds the height of runners 12 as measured from the ground 39 to the runners upper edges 30 so as to enable the plate to rest upon the ground or similar support when shelter 10 is positioned at the desired site and cover 24 is applied. In this manner, with plate 34 in its lowered position as shown in FIGS. 1 and 2, a break is formed to prevent the entry of wind from the rear of the shelter into the interior in front of wall 14.

When shelter 10 is moved from location to location at a particular site when in its usable form with cover 24 in position, the shelter may be towed from its rear end by attaching a rope or towing cord to towing bar 40 connected to the rear most transverse support 15 under seat 16. As the shelter moves from one location to another, any stones, lumps of dirt or snow upon the ground or ice 39 which passes between runners 12 will contact plate 34 and cause the plate to be pivoted upwardly about its connecting hinge 36.

When it is time to transport shelter 10 to a carrier such as a truck, plate 34 can be raised and pivoted upwardly and back over and rest upon wall 14 as best illustrated in FIG. 4 and frames 20 and seat 16 collapsed after the removal of cover 24. When shelter 10 is taken to a new direction site, frames 20 are raised and cover 24 reapplied over the frames with plate 34 being pivoted forwardly from its seat supported position in FIG. 4 to its ground contacting position shown in FIG. 2.

It is to be understood that the invention is not to be limited to the details above given but may be modified within the scope of appended claims.

What is claim is:

1. A portable shelter comprising a pair of spaced apart runners, a frame carried upon said runners, said frame adapted to support a cover with said cover extending downwardly to at least said runners and having at least three enclosing sides, one of said sides adapted to extend to and along each runner, and hinged plate means extending between said runners and shiftable between a lowered position extending to the bottom of said runners for blocking the flow of air between the runners under said covering when supported by said frame and a raised position to allow non-interfering movement of the runner across a supporting surface.

2. The shelter of claim 1 wherein said frame is collapsible and said plate means is supported adjacent the level across the top of said runners when in its raised position.

3. The shelter of claim 2 and a floor extending across the top of said runners, said plate means hinged to said floor.

4. The shelter of claim 3 wherein said plate means is carried upon and overlying said floor when in its said raised position.

* * * * *